United States Patent [19]

Clevinger

[11] Patent Number: 4,567,805

[45] Date of Patent: Feb. 4, 1986

[54] COMPLIANT BRIDGE TRANSDUCER FOR RIGID BODY STRING MUSICAL INSTRUMENTS

[76] Inventor: Martin R. Clevinger, 5410 Telegraph Ave., Oakland, Calif. 94609

[21] Appl. No.: 571,506

[22] Filed: Jan. 17, 1984

[51] Int. Cl.[4] ..... G10H 3/00

[52] U.S. Cl. ..... 84/1.16; 84/1.14; 84/1.15; 84/DIG. 24

[58] Field of Search ..... 84/1.14, 1.15, 1.16, 84/DIG. 24

[56] References Cited

U.S. PATENT DOCUMENTS

| | | | |
|---|---|---|---|
| 3,113,990 | 12/1963 | Zanessi | 84/1.16 |
| 3,539,700 | 11/1970 | Johnson | 84/1.15 |
| 3,600,496 | 8/1971 | Ellis | 84/1.15 |
| 3,600,497 | 8/1971 | Zanessi | 84/1.14 |
| 4,147,084 | 4/1979 | Underwood | 84/1.16 |

*Primary Examiner*—Forester W. Isen

*Attorney, Agent, or Firm*—Limbach, Limbach & Sutton

[57] ABSTRACT

An improved bridge transducer for rigid non-acoustic body string musical instruments, enabling production of tonal character and quality associated with flexible acoustic body instruments using a novel compliant suspension supporting a string bridge, which is equally responsive to plucked or bowed strings, is interactive with the strings in a manner similar to acoustic body supported bridges, while eliminating problems of diminished string sustain, and air coupled loud speaker feedback, uneven frequency response, and is economical to manufacture. A sound pickup device is coupled to the suspended string bridge for detection and amplification of motion induced by played strings.

34 Claims, 7 Drawing Figures

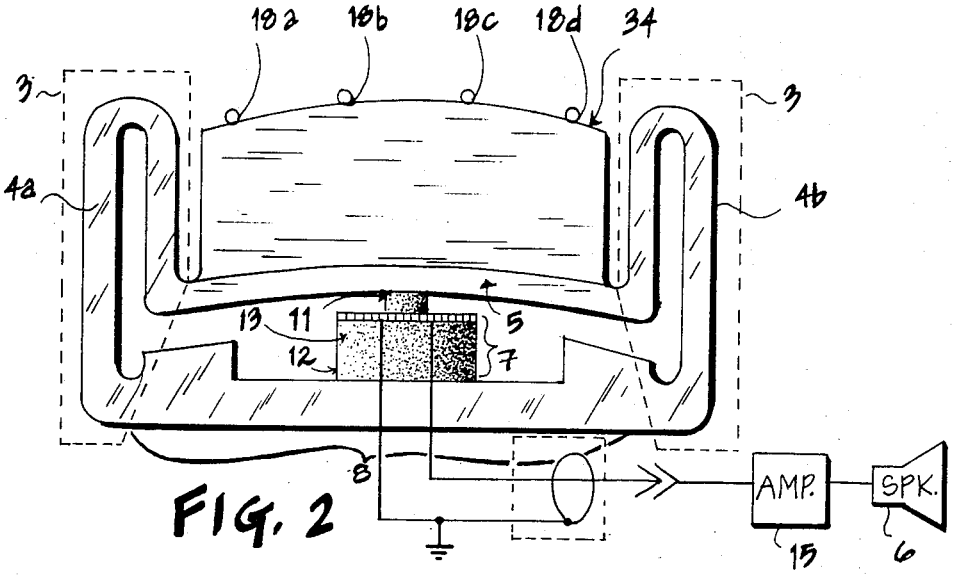
FIG. 2
FIG. 3
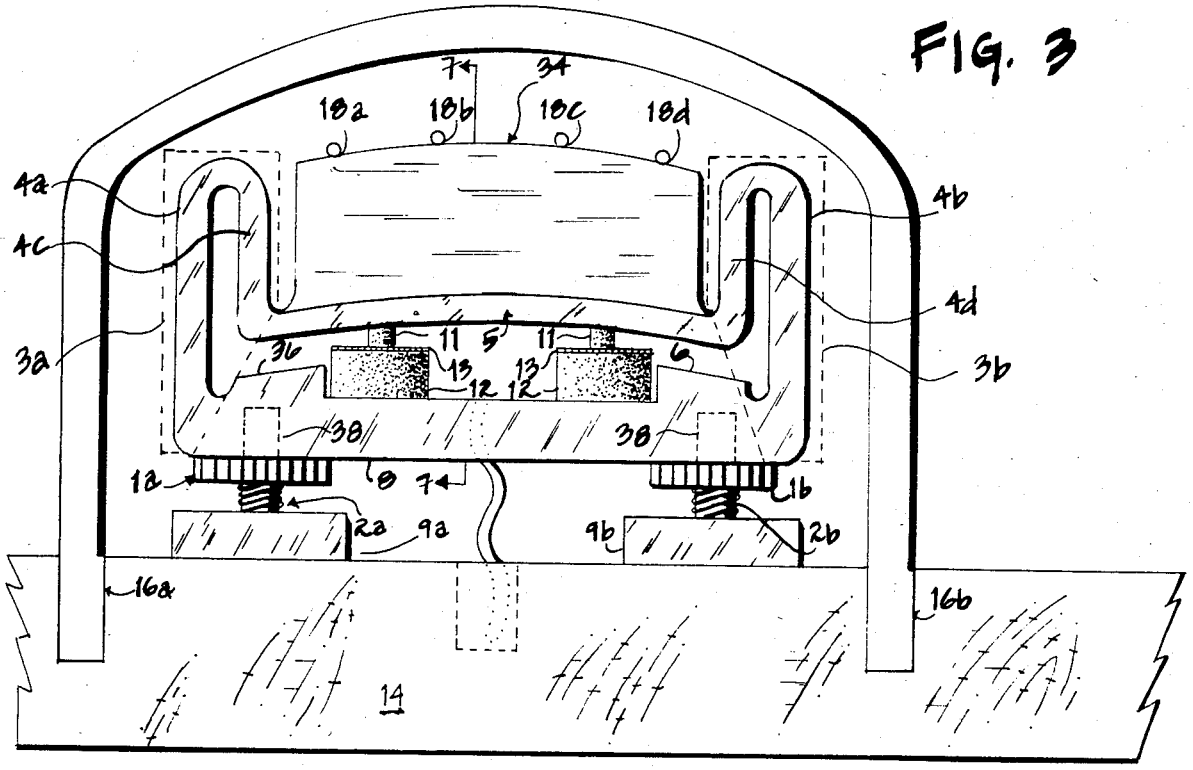

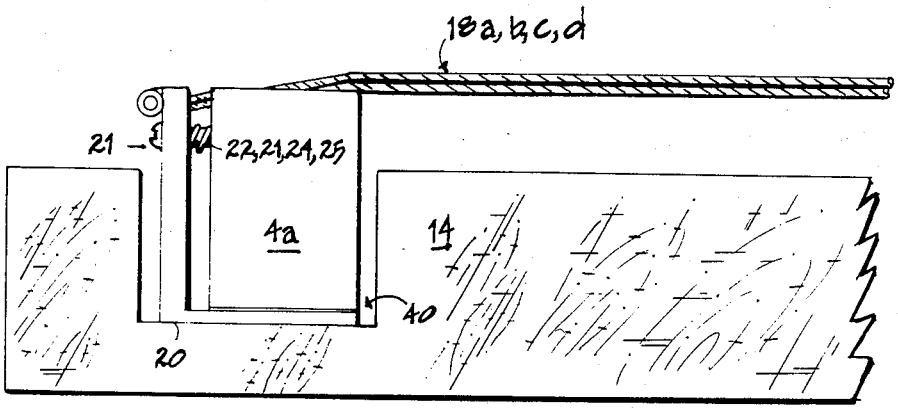
FIG. 4
FIG. 5
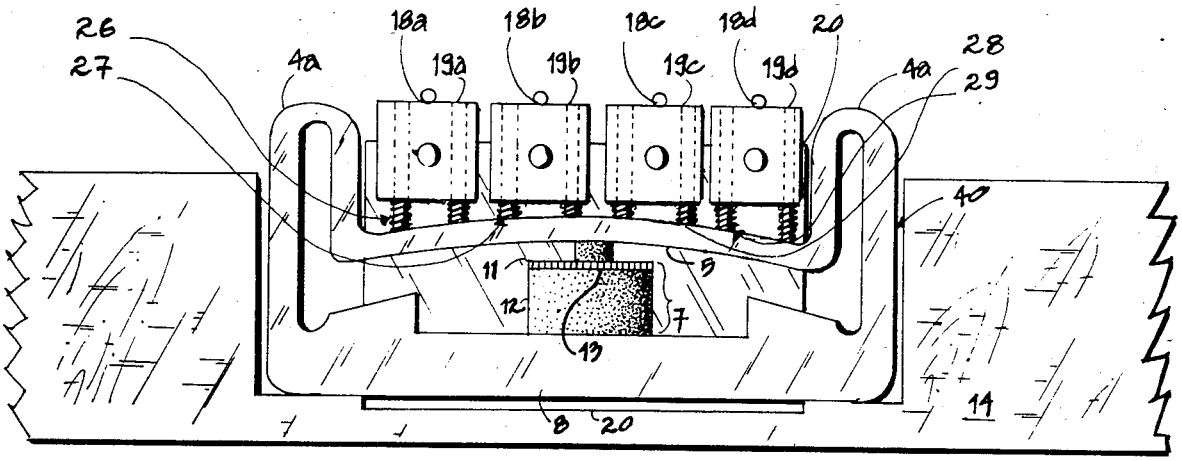

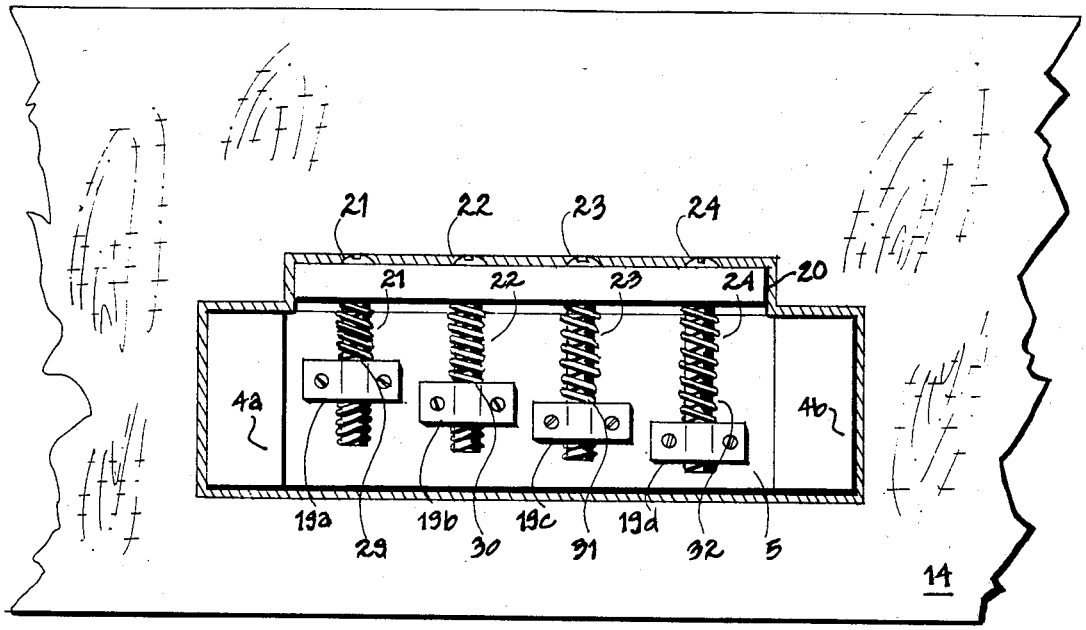
FIG. 6
FIG. 7
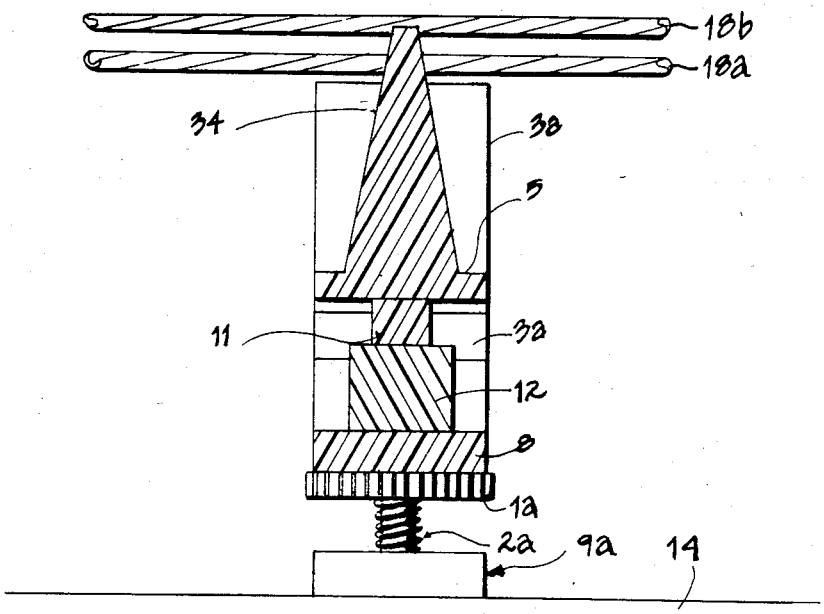

COMPLIANT BRIDGE TRANSDUCER FOR RIGID BODY STRING MUSICAL INSTRUMENTS

DESCRIPTION

1. Technical Field

The present invention relates generally to the conversion of physical motion into electrical signals and, more specifically, to a bridge sound pickup for string musical instruments, which is able to physically interact with vibrating strings in a manner similar to flexible acoustic bodies. The invention may be applied to any string musical instrument, and is especially applicable to solid rigid body string instruments which previously have been unable to produce the sound quality associated with acoustic bodied instruments.

2. Background Art

The disclosed invention enables rigid body string musical instruments, with their known advantages, to produce a tonal quality previously available only in flexible hollow body acoustic string musical instruments.

Acoustic instruments are known to be feedback prone, to lack string sustain and to possess uneven frequency response; but are also known to have a tonal quality superior to solid rigid body instruments. This quality is attributable in part to the physically direct manner in which the tensioned vibrating strings interract with the soundboard-supported bridge and flexible body.

The wide dynamic range, frequency response, and sensitivity-to-playing nuance attributed to acoustic instruments are made possible largely by the direct mechanical coupling of the strings to the physically-displaceable, sound-producing acoustic body. As the body is vibrated by the moving strings, a direct feedback relationship between the strings and body-mounted bridge results.

The present invention preserves this interaction between the vibrating strings and moveable bridge while substantially eliminating diminished string sustain, uneven frequency response, and unwanted air-coupled acoustic feedback from loud speakers. The invention enables musically actuated strings to transfer their motion to a bridge structure incorporating a novel folded compliant bridge suspension which is acoustically coupled to self-contained sound pickup devices and mountable on rigid solid body string instruments.

The folded compliant bridge suspension is susceptible to displacement caused by the different forces of vibrational motion applied by both plucked or bowed strings. This produces multi-directional acoustic motion and susceptibility-to-motion inducement of a magnitude previously available only in flexible hollow acoustic instrument bodies.

Bridge pickups intended for use on solid body or non-acoustic bodied instruments have been attempted in the past. Les Paul U.S. Pat. No. 3,018,680 describes a bridge incorporating a magnetic pickup coil suspended by the strings, which do not bear down on the sound pickup means. In the system, no attempt is made to allow string-bridge interaction as is present in traditional acoustic instruments. The resulting musical output signal, therefore, cannot closely resemble the sound quality of a traditional acoustic instrument.

Other bridge pickups, such as those described in Charles E. Hull and Oliver Jessperson U.S. Pat. No. 3,244,791, include an aluminum bridge, under the tensioned strings, that bears directly upon metal discs. The metal discs are displaced by vibrations coupled through the bridge. These displacements are then magnetically sensed using coils placed in close proximity to the metal discs. These bridge structures are unable to duplicate acoustic motion with the accuracy found in acoustic bodied instruments, due to physical constraints, lack of compliance and acoustical resonances of the metal discs and the aluminum bridge structure.

Chauncy R. Evans U.S. Pat. No. 3,137,754 appears to mount each string on an independent bridge structure, bearing directly upon a piezo transducer, in an attempt to isolate the various strings from each other. Further, since the piezo transducers are wired out of phase with respect to each other, the entire structure is of a rigid in nature to prevent "crosstalk" between strings. This structure, therefore, does not allow sufficient compliance for generation of fundamental tones. Moreover, the structure suffers from unrealistic effects caused by the restricted interaction between strings. As discussed above, interaction between strings is germane to producing tonal quality and characteristics found in fine acoustic instruments.

In the past, it has been thought that rigid bridge structures maximize string sustain by preventing energy loss in the vibrating string. Thus, many of the previous bridge structures are characterized by an emphasis on rigidity.

The subject of string motion has been described in *On The Action Of The Strings Of A Violin* by Herman Von Helmholtz, 1860, "Proceedings of the Glasglow Philosophical Society", and other articles suqh as *The Physics Of The Bowed String* by John C. Schelleng, "The Physics of Music", pages 69–77, Popular Sciences Publications, 1978.

It is well-known that string motion of bowed strings differs from string motion of plucked strings. Thus, bowed strings induce motions in acoustic coupling systems which are dissimilar to the motions induced by plucked strings. Therefore, acoustic coupling systems which may be susceptible to displacement by plucked strings may not respond equally well to bowed strings.

SUMMARY OF THE INVENTION

The foregoing and other problems of prior art bridge pickup systems are overcome by the present invention which provides a novel bridge structure which permits duplication of the complex motion which occurs in acoustic bodied instruments when their tensioned strings are perturbated. The present invention includes bridge span means which are shaped to support the strings and to transmit string motion, suspension means for compliantly supporting the bridge span means relative to the instrument body, and transducer means coupled to the bridge span means for receiving the transmitted string motion and for converting the received motion into electrical signals which are suitable for conversion into sound.

The present invention eliminates the problem of compatability of bridge structures to plucking and bowing by providing a compliant folded bridge suspension which is susceptible to displacement in widely varied directions. In addition to improved multi-directional sensitivity, the folded compliant bridge system allows substantial excursion of the acoustic coupling members for maximizing displacement of the transducer means, such as piezo elements, for sound amplification. This eliminates the need for preamplification of the output signal of the transducer means while effectively duplicating the pleasing tonal qualities found in acoustic bodied string instruments.

Contrary to the teachings of prior bridge structures, it has been discovered that a bridge structure that is biased by the tensioned strings and the spring tension of a compressed, folded compliant bridge suspension provides a surprising amount of string sustain. This is because the structure provides a spring energy storage ability which is capable of storing energy when the strings are vibrating and effectively returning energy into the vibrating strings. This spring energy storage system is similar to the operation of fine acoustic string instruments. Energy loss in the present invention in the form of heat generation is minimized due to the small size, small mass, and minimal damping characteristics of the folded compliant bridge structure.

Judicious choice of structural material in the construction of the bridge permits the elimination of unwanted resonances as well as enables economical manufacture of the bridge structure.

Furthermore, because the present invention can be used on solid body instruments, the air-coupled feedback associated with hollow acoustic bodied string instruments can be substantially eliminated.

It is, therefore, an object of the present invention to provide an ecomonical and improved means of producing string instrument sound pickup devices for rigid body string instruments providing tonal qualities previously available only in problematical acoustic bodied instruments.

It is also an object of the invention to provide a bridge pickup which supplies the mechanical feedback and interaction between the vibrating strings and the displaceable bridge as is apparent in fine acoustic string instruments.

Another object of the invention is to provide a rigid solid body string instrument with an acoustically coupled transducer system which is capable of transforming the dissimilar acoustic motions of bowed or plucked strings into electrical signals of equal magnitude and tonal quality.

It is a further object of the invention to provide acoustic body tonal qualities in an amplifiable acoustic coupling system which is substantially free of unwanted resonances and body noise, thus providing even response from all played musical pitches.

A still further object of the invention is to provide an acoustically coupled sound pickup device which substantially eliminates the unwanted air-coupled feedback associated with hollow acoustic bodied string instruments while preserving the desirable sonic characteristics of acoustic bodied string instruments, thus enabling use of the instrument in louder musical environments.

The above and other objectives, features and advantages of the present invention will be more readily understood upon consideration of the following detailed description of certain preferred embodiments of the invention taken in conjunction with the accompanying drawings.

BRIEF DESCRIPTION OF THE DRAWINGS

FIG. 2 is a simplified illustration of the invention in relation to a sound amplification application.

FIG. 3 is an end view of the invention equipped with two transducers surface-mounted on a typical solid body string instrument and showing the bridge guard.

FIG. 4 is a side cross-sectional view of the invention as applied to a bass guitar or the like.

FIG. 5 is a cross-sectional end view of the invention as applied to an instrument such as a bass guitar.

FIG. 6 is the top plan view of the invention as applied to a string instrument such as a bass guitar.

FIG. 7 is a cross-sectional view of the present invention taken along line 7—7 in FIG. 3.

DETAILED DESCRIPTION OF THE INVENTION

Figure 1:
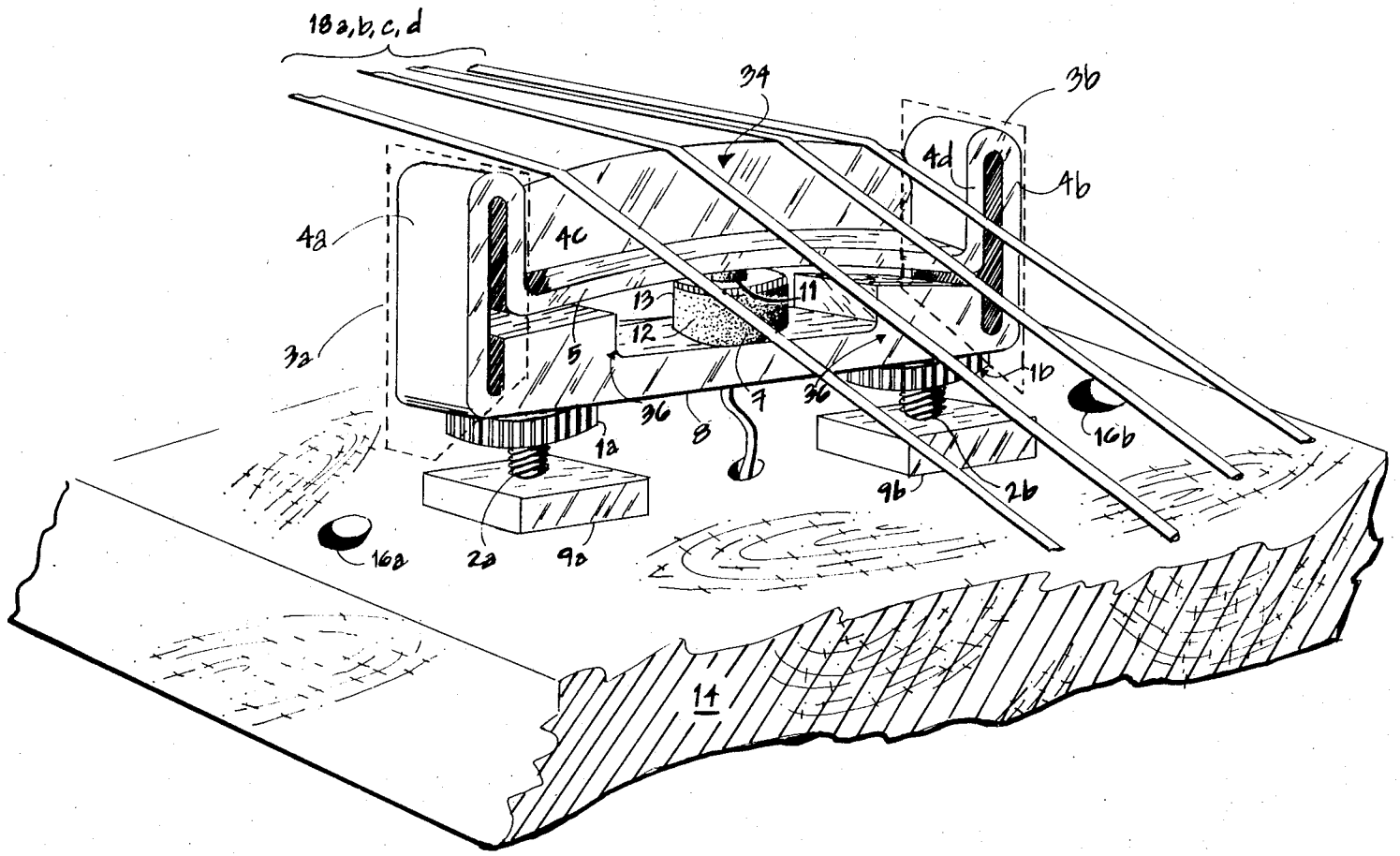
FIG. 1 is a perspective view of the present invention which has been surface-mounted on a typical solid body string musical instrument.

Referring to the drawings, FIGS. 1, 2, and 3 depict the invention as typically mounted on a solid rigid, slab-body, string instrument. In FIG. 1, the invention is surface mounted as would be the case when the invention is applied to string musical instruments intended for bowing as well as plucking.

Height adjusting feet 9*a* and 9*b* rest upon the solid body 14. The height adjusting feet include threaded studs 2*a* and 2*b* for mounting height adjusting wheels 1*a* and 1*b*. The height adjusting wheels 1*a* and 1*b* enable the user to adjust the height, i.e. the playing action, of the strings 18*a*, 18*b*, 18*c*, and 18*d* relative to the solid body 14.

A rigid base support 8 rests upon the height adjusting wheels 1*a* and 1*b* and includes reinforcing blocks 36 and wells 38 for receiving threaded studs 2*a* and 2*b*.

Attached to the two outer sides of the rigid base support 8, are sidewalls 4*a* and 4*b* which form the outer portion of the folded compliant bridge suspension 3*a* and 3*b*. The folded compliant bridge suspension 3*a* and 3*b* supports the bridge span 5 which is born upon-by the bridge crown 34. The compliant bridge suspension 3*a* and 3*b* preferrably has a shape which can be characterized as "folded", "arched" or "U" shaped.

In the example of the invention shown in FIG. 1, the crown 34 can be a single arched member for bowable string instruments. The crown 34 is under the pressure of the tensioned strings 18*a*, 18*b*, 18*c*, and 18*d* and bears upon a drive pad 11. Drive pad 11, via resilient support pad 12, exerts pressure upon the center of piezo element 13. Piezo electric element 13 can thus be displaced according to perturbations in the elements physically bearing upon the resilient support pad 12. Piezo electric element 13 is thus biased between the forces applied to the folded compliant bridge suspension by the tensioned strings 18*a*, *b*, *c*, and *d* and the compression of the resilient material of support pad 12.

Resilient support pad 12 and drive pad 11 can be made of neoprene or a similar substance. The piezo electric element 13 can be a ceramic bimorph of the type manufactured by Vernitron Piezo-electric of Bedford, Ohio. Preferrably, drive pad 11 is a pill shaped cylinder wherein the diameter of the pad 11 is less than the diameter of the piezo electric element 13 and is small enough to avoid generation of out-of-phase signals. For a crystal face having a diameter of seven-eighths ($\frac{7}{8}$) of an inch, a drive pad diameter of one-eighth ($\frac{1}{8}$) of an inch and a thickness of at least one-sixteenth (1/16) of an inch has been found to be satisfactory. The two crystal faces of the ceramic bimorph can be wired in series for a high level output, or in parallel for a lower level output more compatible with common magnetic sound pickup devices.

For bowable instruments, the preferred embodiment of the present invention can have a width, from sidewall 4a to sidewall 4b, of approximately four (4) inches. The depth of the sidewalls 4a and 4b, the bridrge span 5, and the rigid base 8, can be approximately one (1) inch. The height of each sidewall 4a and 4b can be approximately one and three-quarter (1-¾) inches.

The thickness of compliant sections 3a and 3b is preferrably one-eighth (⅛) inch, while the thickness of bridge span 5 and rigid base 8 is preferrably one-fourth (¼) inch. The overall thickness of the rigid base 8 in the vicinity of the reinforcing blocks 36 is approximately one-half (½) inch.

In the preferred embodiment of the present invention for bowable instruments, the bridge span 5 has a radius of curvature of approximately twelve (12) inches. Further, the outer sidewall of each compliant section 3a and 3b is preferrably separated from the inner wall 4c and 4d by approximately one-eighth (⅛) inch. As such, the separation between the bridge span 5 and the rigid base 8 is approximately one-half (½) inch in the vicinity of the transducer 7, while the separation between the bottom of the bridge span 5 and the top of the reinforcing blocks 36 is approximately one-eighth (⅛) inch.

Referring to FIG. 7, a cross section of the bowable string bridge embodiment of the present invention is shown taken along line 7—7 in FIG. 3. In the preferred embodiment crown 34 tapers from approximately one (1) inch, at the point where it joins bridge span 5, to approximately one-eighth (⅛) inch, at the point where it makes contact with the strings 18a, 18b, 18c, and 18d.

It is to be understood that the dimension of the compliant sections 3a and 3b are selected to minimize the mass of these sections to thereby minimize heat loss.

In operation, the present invention provides an energy storage/acoustic wave guide system which enhances string sustain and permits a pleasing interaction of string motion from the various strings supported thereby. The compliant sections 3a and 3b can be likened to folded acoustic wave guides which have an acoustic length and material properties so as to store energy from the string motion. As such, the length of these sections is selected to correspond, approximately, to audio frequencies higher than the audible range of frequencies produced by the associated strings. This prevents resonant peaks in the produced audio signal. Preferably, the compliant sections 3a and 3b have a length which is less than ½ wavelength of the highest frequency in the audible range of frequencies. The bridge span 5 and crown 34 can be likened to string motion transmitters which transmit string motion to and receive energy from the compliant sections 3a and 3b. The rigid base 8 and height adjustment feet 9a and 9b act as rigid bodies so as not to absorb any of the energy from the compliant sections 3a and 3b.

It is to be understood that the number of strings bearing upon crown 34 is not limited to the number shown in the figures and that the strings can be anchored at their ball-end by prior art tailpieces or other string achor means.

In FIG. 2, it can be seen that the output leads from the piezo electric element 7 are connected through a shielded cable to amplifier 15 and speaker 6. FIG. 3 shows an end view of the invention surface mounted with bridge guard 17. This bridge guard 17 can be manufactured from Delrin® and inserted into mounting holes 16a and 16b, which are provided in body 14. The bridge guard 17 protects the strings and folded compliant bridge suspension from accidental impact and shock.

FIGS. 4, 5 and 6 depict the invention as applied to string musical instruments such a solid body bass guitars, guitars and the like. As is shown in FIG. 4, the solid body 14 includes mounting recess 40 for accommodating the bridge structure. In this embodiment, string anchor plate 20 is provided for anchoring the strings 18a, *b*, *c*, and *d*. However, it is to be understood that other string anchor means, tailpieces or the like may be used in conjunction with the invention.

As shown in FIG. 5, the invention can include independently height-adjustable crown sections 19a, 19b, 19c, and 19d. This enables the bridge structure to conform to the many different string arch radii and player preferences for string height. The adjustable crown sections 19a, 19b, 19c, and 19d are longitudinally adjustable by means of longitudinal adjusting screws 21, 22, 23 and 24 which are anchored in holes provided in string anchor plate 20. See FIGS. 5 and 6. Expansion springs 25, 26, 27 and 28 maintain the longitudinal position of the adjustable crown sections 19a, 19b, 19c, and 19d. Crown height adjusting screws 26a, 26b, 27a, 27b, 28a, 28b, and 29a, 29b enable height adjustment of each crown sections. These crown sections can be constructed of materials which provide minimal energy storage properties, such as polycarbonate, polyamide, similar plastics or aluminum.

These materials are also of uniform physical consistency so that excessive heat loss in the material is minimized.

The folded compliant bridge structure may be injection molded or heat formed from polycarbonate plastic such as Lexan®, manufactured by General Electric Company, hardwood or combinations of any strong resilient materials, provided these materials possess the necessary acoustical qualities for preventing resonant frequencies as is necessary for even frequency response.

Unwanted resonances in the compliant bridge transducer are minimized by the geometric dimensions employed and by the use of materials which are substantially immune to unwanted audible resonance. Fiberglass reinforced epoxy satisfies these requirements although other suitable materials may also be used to carry out the invention. Thus, the invention may be very economical to produce using casting or injection molding technology.

In the present invention, it is the geometry of the compliant sections 3a and 3b, which act much like a spring, that provides the acoustic energy storage. This is to be distinguished from acoustic energy storage exhibited in certain metals such as steel and brass which produce unwanted resonances.

As can be seen in FIG. 1, the compliant sections 3a and 3b are formed without sharp corners to eliminate acoustical reflections due to sharp transitions in the acoustic wave path and to minimize stress points.

While the present invention has been described in connection with piezo electric transducers, it is to be understood that other forms of transducers can be used. These include magnet/coil pickups, magnetic-phono cartridge type pickups, and other piezo electric type pickups. In the magnet/coil pickup context, a magnet can be attached to the vibratible bridge-span 5, in the same position of drive pad 11 of FIG. 3. The coil could be mounted on the non-moveable bridge base 8. The magnet would be operatively associated with the coil and would move in accordance with the motion of bridge span 5. The same effect can be achieved by interchanging the magnet with the coil. It is to be understood that any means of sensing motional differences between the bridge spans and the rigid base structure 8 can be used for the production of the electrical signal in accordance with the present invention.

The terms and expressions which have been employed here are used as terms of description and not of limitations, and there is no intention, in the use of such terms and expressions of excluding equivalents of the features shown and described, or portions thereof, it being recognized that various modifications are possible within the scope of the invention claimed.

I claim:

1. An improved string instrument of the type having a plurality of strings that are tensioned across a body and which can be set into motion by bowing or plucking, the improvement comprising a compliant bridge pickup including bridge span means for supporting the strings and for transmitting the motion of the strings;

means for compliantly supporting the bridge span means relative to the body which includes a folded suspension structure connected between the bridge span means and the body; and transducer means coupled to the bridge span means for receiving the transmitted string motion and for converting it into an electrical signal which is suitable for conversion into sound.

2. The improved string instrument of claim 1 wherein the bridge span means are formed to be substantially rigid.

3. The improved string instrument of claim 1 wherein the bridge span means comprise crown means for transversely supporting the strings in a predetermined formation; and arch means for supporting the crown means, said arch means being mechanically coupled to the crown means.

4. The improved string instrument of claim 3, wherein the crown means comprise an extended ridge-shaped member having string contact surfaces which are contoured to support the strings in the predetermined formation.

5. The improved string instrument of claim 4 wherein said extended ridge-shaped member comprises a plurality of sections, wherein each section is associated with one of the strings and supports its associated string with respect to the arch means, and each section further including means for adjusting the distance of the associated string from the arch means, so that the plurality of sections collectively define the contact surface of the ridge-shaped member.

6. The improved string instrument of claim 4, wherein said extended ridge-shaped member has a thickness which is smallest in the vicinity of the string contact surface and largest in the vicinity of the arch means.

7. The improved string instrument of claim 1, wherein the compliant supporting means is shaped and constructed to be compliant so as to store energy from the transmitted string motion, and further wherein the compliant supporting means returns the stored energy to the bridge span means.

8. The improved string instrument of claim 7 wherein the compliant supporting means further include means for anchoring the compliant support means to the body which anchoring means are substantially non-compliant.

9. The improved string instrument of claim 8, wherein the anchoring means comprise a substantially non-compliant base span which supports the compliant supporting means; and means disposed between the base span and the body for adjusting the distance of the bridge span from the body.

10. The improved string instrument of claim 7, wherein the compliant supporting means are shaped to suspend the bridge span means relative to the body.

11. The improved string instrument of claim 10, wherein the compliant supporting means comprise first and second arch-shaped members, each member having a short leg and a long leg and further wherein the short leg of each member is secured to the bridge span means and the long leg of each member is mounted on the body so that the bridge span means are suspended by the first and second arch-shaped members relative to the body.

12. The improved string instrument of claim 11, wherein the arch-shaped members have a uniform thickness and further wherein the legs of the arch are positioned substantially parallel with respect to one another and separated by a distance which is substantially equal to the thickness of the arch-shaped members.

13. The improved string instrument of claim 7, wherein the compliant supporting means include first and second "U"-shaped members, each member having a first leg which is secured to the bridge span means and a second leg which is secured to the body, the length of the first and second legs being selected so that the bridge span means are suspended relative to the body.

14. The improved string instrument of claim 13, wherein the string motion lies within an audible acoustic frequency range and further wherein each "U"-shaped member has a length which is less than the wavelengths of any of the frequencies in the audible acoustic frequency range so that substantially uninhibited motion of the moveable member is permitted, which motion is analogous to the acoustic motion of the associated strings in the audible acoustic frequency range, and so as to avoid resonances in the moveable member within the audible acoustic frequency range.

15. The improved string instrument of claim 14, wherein the length of each "U"-shaped member is less than one-half the wavelength of the highest frequency in the audible acoustic frequency range.

16. The improved string instrument of claim 1 wherein the transducer means comprise a magnetic transducer coupled between the bridge span means and the body to sense the differential motion of the bridge span means in relation to the body.

17. The improved string instrument of claim 16 wherein the transducer means comprise magnet means coupled to the bridge span means for movement therewith for generating a magnetic field which varies in accordance with the transmitted string motion; and coil means positioned with respect to the magnet means for converting the magnetic field into the electrical signal.

18. The improved string instrument of claim 1 wherein the transducer means comprise means fixed in position with respect to the body for converting variations in pressure into electrical signals; and coupling means sandwiched between the converting means and the bridge span means for transmitting the string motion to the converting means by applying pressure to the converting means which pressure varies in accordance with the string motion.

19. The improved string instrument of claim 18 wherein the converting means include a piezo electric crystal.

20. The improved string instrument of claim 19, wherein the coupling means include a pill-shaped member which is constructed from a resilient material.

21. The improved string instrument of claim 20, wherein the pill-shaped member has a diameter which is less than the diameter of the piezo electric crystal so as to eliminate generation of out-of-phase signals within the crystal.

22. A bridge pick-up for use in string instruments of the type having a plurality of strings that are tensioned across a body and which can be set into motion by bowing or plucking, the pick-up comprising bridge span means for supporting the strings and for transmitting the motion of the strings;

means for compliantly supporting the bridge span means relative to the body including a folded suspension structure connected to the bridge span means and the body; and transducer means coupled to the bridge span means for receiving the transmitted string motion and for converting it into an electrical signal which is suitable for conversion into sound.

23. The pick-up of claim 22 wherein the bridge span means are formed to be substantially rigid.

24. pick-up of claim 22 wherein the bridge span means comprise crown means for transversely supporting the strings in a predetermined formation; and arch means for supporting the crown means, said arch means mechanically contacting the crown means along the convex surface of the arch means.

25. The pick-up of claim 24, wherein the crown means comprise an extended ridge-shaped member having string contact surfaces which are contoured to support the strings in the predetermined formation.

26. The pick-up of claim 25 wherein said extended ridge-shaped member comprises a plurality of sections, wherein each section is associated with one of the strings and supports its associated string with respect to the arch means, and each section further including means for adjusting the displacement of the associated string from the arch means, so that the plurality of sections collectively define the contact surface of the ridge-shaped member.

27. The pick-up of claim 22, wherein the compliant supporting means are shaped and constructed to be compliant so as to store energy from the transmitted string motion with minimum energy loss, and further wherein the compliant supporting means returns the stored energy to the bridge span means.

28. The pick-up of claim 27, wherein the compliant supporting means are shaped to suspend the bridge span means relative to the body.

29. The pick-up of claim 28, wherein the compliant supporting means comprise first and second archshaped members, each member having a short leg and a long leg and further wherein the short leg of each member is secured to the bridge span means and the long leg of each member is mounted on the body so that the bridge span means are suspended by the first and second archshaped members relative to the body.

30. The pick-up of claim 27, wherein the compliant supporting means include first and second "U"-shaped members, each member having a first leg which is secured to the bridge span means and a second leg which is secured to the body, the length of the first and second legs being selected so that the bridge span means are suspended relative to the body.

31. The pick-up of claim 30, wherein the string motion lies within an acoustic frequency range and further wherein each "U"-shaped member has a length which is less than the wavelengths of any of the frequencies in the audible acoustic frequency range so that substantially uninhibited motion of the moveable member is permitted, which motion is analogous to the acoustic motion of the associated strings in the audible acoustic frequency range, and so as to avoid resonances in the moveable member within the audible acoustic frequency range.

32. The pick-up of claim 22 wherein the transducer means comprise means fixed in position with respect to the body for converting variations in pressure into electrical signals; and coupling means sandwiched between the converting means and the bridge span means for transmitting the string motion to the converting means by applying pressure to the converting means which pressure varies in accordance with the string motion.

33. An improved bridge for use in string instruments of the type having a plurality of strings that are tensioned across a body and which can be set into motion by bowing or plucking, and pickup means for converting the string motion into electrical signals, the improvement comprising bridge span means for supporting the strings and for transmitting the motion of the strings;

means for compliantly supporting the bridge span means relative to the body including a folded suspension structure connected to the bridge span means and the body, wherein the compliant supporting means are shaped and constructed so as to be compliant to store energy from the transmitted string motion with low energy loss, and to return the stored energy to the bridge span means.

34. The improved bridge of claim 33 wherein the mass of the compliant supporting means is small relative to the mass of the bridge span means and the compliant supporting means are constructed of material having uniform physical consistency so as to minimize energy loss and to maximize string sustain.

* * * * *